US010245522B1

(12) United States Patent
Williams

(10) Patent No.: US 10,245,522 B1
(45) Date of Patent: Apr. 2, 2019

(54) SNOWMAN MAKER

(71) Applicant: Brett M. Williams, Chesterfield, MO (US)

(72) Inventor: Brett M. Williams, Chesterfield, MO (US)

( * ) Notice: Subject to any disclaimer, the term of this patent is extended or adjusted under 35 U.S.C. 154(b) by 0 days.

(21) Appl. No.: 15/964,280

(22) Filed: Apr. 27, 2018

(51) Int. Cl.
*A63H 33/00* (2006.01)
*F25C 3/00* (2006.01)

(52) U.S. Cl.
CPC ..... *A63H 33/001* (2013.01); *F25C 3/00* (2013.01)

(58) Field of Classification Search
CPC ... F25C 1/22; F25C 3/00; B29C 33/48; B29C 43/021; B29C 39/028; A63H 33/32; A63H 33/001; B44C 5/00
See application file for complete search history.

(56) References Cited

U.S. PATENT DOCUMENTS 2,310,956 A * 2/1943 Hoy ..... A22C 7/0046 99/351
3,059,279 A * 10/1962 Rossi ..... A63H 33/32 249/126
3,861,640 A * 1/1975 Agneta ..... B29C 33/306 249/102
4,164,341 A * 8/1979 McComb ..... A63H 33/001 249/126
5,191,830 A * 3/1993 Jacobson ..... A21B 3/132 249/120
D375,964 S * 11/1996 Poubouridis ..... D15/136
5,632,926 A * 5/1997 Dyer, Jr. ..... A63H 33/001 249/121
D384,960 S * 10/1997 Kistler ..... D15/135
5,814,380 A * 9/1998 Tamborello ..... B29C 49/0047 428/12
5,851,415 A * 12/1998 Thomas ..... A23G 9/221 249/117
6,126,876 A * 10/2000 Demarzo ..... A63H 33/32 264/109
D435,069 S * 12/2000 Berardelli ..... 446/70
6,176,464 B1 * 1/2001 Harvey ..... A63H 33/001 249/126
6,226,068 B1 * 5/2001 Arcykiewicz ..... H01R 13/625 439/314
6,506,094 B1 * 1/2003 Chang ..... A63H 3/16 446/268

(Continued)

*Primary Examiner* — Yogendra N Gupta
*Assistant Examiner* — Emmanuel S Luk
(74) *Attorney, Agent, or Firm* — Sanchelima & Associates, P.A.; Christian Sanchelima; Jesus Sanchelima

(57) ABSTRACT

The present invention provides a snowman maker comprising multiple mold sections. The mold sections can be stacked on top of each other and interlocked with each other for assembling and disassembling of the snowman maker. The mold sections are sub-divided into halves that can be stacked on top of each other and interlocked with each other for assembling and disassembling of the snowman maker. Further, at least some of the mold section halves are sub-divided into two or more equal segments which are placed side-by-side and can be laterally moved for easy transportation and storage of the snowman maker. The different parts can be filled with snow and easily coupled for assembling the snowman, and later separated for disassembling of the snowman maker to reveal the snowman formed therein.

19 Claims, 5 Drawing Sheets

(56) References Cited

U.S. PATENT DOCUMENTS

| | | | | |
|---|---|---|---|---|
| D503,125 | S * | 3/2005 | Federic | D11/121 |
| 7,000,887 | B1 * | 2/2006 | Mulhern | A63H 33/001 249/155 |
| D535,348 | S * | 1/2007 | Sammann | D21/398 |
| 7,178,342 | B1 * | 2/2007 | Knapp | B44C 5/00 62/1 |
| 7,963,500 | B1 * | 6/2011 | Holiday | B29C 39/02 249/117 |
| 8,549,726 | B2 * | 10/2013 | Washburn | B44C 5/00 249/139 |
| 2005/0249835 | A1 * | 11/2005 | Racunas, Jr. | A63H 33/32 425/470 |
| 2011/0277310 | A1 * | 11/2011 | Washburn | B44C 5/00 29/527.1 |
| 2014/0209116 | A1 * | 7/2014 | Seibt | B44C 3/12 132/275 |
| 2015/0253067 | A1 * | 9/2015 | Bucceri | B65D 85/78 62/66 |
| 2016/0114254 | A1 * | 4/2016 | Diaz | A63H 33/001 249/126 |
| 2017/0010033 | A1 * | 1/2017 | Garcia | A63H 33/001 |
| 2017/0050118 | A1 * | 2/2017 | LaDuke | B44C 5/00 |
| 2017/0266575 | A1 * | 9/2017 | Mileto | A63H 33/001 |
| 2018/0071649 | A1 * | 3/2018 | Fedrick | A63H 33/001 |

* cited by examiner

SNOWMAN MAKER

BACKGROUND OF THE INVENTION

1. Field of the Invention

The present disclosure generally relates to a snowman maker, and more particularly to a mold structure having multiple sections for forming snowman or similar large figures from snow.

2. Description of the Related Art

Traditionally, snowmen or other figures of snow are formed by rolling small snowballs in the snow until packed large balls of snow of desired size are reached. For small sized snowmen, the finished packed balls of snow can fairly easily be placed on top of each other to form the desired figure. However, in forming the larger figures, most often picking up the finished packed balls of snow for placement on top of each other presents a challenge. This may even pose as a hazard, especially for the very young and very old.

Some structures for molding a snowman have been proposed in the prior art. These mold structures allow snow to be deposited therein. Once the snow is packed in such mold structures, the structure is removed to reveal a snowman shape. Although, such mold structures may be effective in operation, these molds either do not produce a well-formed snowman, and/or are difficult for a child to safely manipulate.

For example, U.S. Pat. No. 4,164,341 (referred to as '341 patent) discloses a hollow mold assembly for the forming of large figures from snow comprising at least two mold sections, each of said mold sections being substantially a mirror image of the other and extending in one piece from the top of the figure to be formed to the bottom, said mold sections being mateable to form a hollow figure, said figure being formed of successively smaller substantially spherical portions, including a base portion, a body portion and a head portion, and at least three large openings formed in said mold sections for the admission and packing of snow to the entire interior of said mold, each of said openings being associated with one of said spherical portions for the easy admission of snow to each respective spherical portion.

It is to be understood that, typically, a snowman is a tall figure approximating, and often being higher than, the height of an adult human. Therefore, the disclosed hollow mold assembly of the '341 patent with single mold (or sections thereof) large enough to contain and form such a figure would be too large and bulky, and therefore difficult and cumbersome for a child to handle conveniently.

In other example, U.S. Pat. No. 6,176,464 (referred to as '464 patent) discloses a snowman mold having a base member and a torso member defining interior spaces for receiving snow therein. The mold members include annular flanges extending radially outwardly from the members in a configuration that allows the torso member to be stacked upon and releasably secured to the base member prior to filling with snow. While the base and torso members have a substantially similar configuration, the torso member presents a circumference dimension that is smaller than the circumference dimension of the base member such that the torso member fits within the base member in a storage configuration. A snowman is constructed by placing the base member on a surface, stacking and securing successively smaller mold members thereon, and depositing snow into the opening in the uppermost member. When the mold is completely filled, the members may be successively removed by opening the doors of each member and releasing the fasteners coupling the members together.

The snowman mold of the '464 patent requires use of fasteners for stacking together the different mold sections. The use of fasteners makes it difficult for a child as it would require to handle tools for tightening the different sections together, which is cumbersome and inconvenient. Further, the portions of the mold sections are pivotally coupled together which makes it vulnerable to destroy the figure of the snowman formed therein while trying to disassemble the snowman mold.

Accordingly, there is a need to provide an improved snowman maker for forming a snowman, or like desired figure. The various documents describing the closest subject matter provide for a number of more or less complicated features that fail to provide effective solution. None of these documents suggest the novel features of the present invention.

SUMMARY OF THE INVENTION

It is one of the main objectives of the present invention to provide a snowman maker which is capable of molding a traditional snowman.

It is another objective of the present invention to provide a snowman maker which is easy and intuitive to handle for forming the snowman, even by a child and a senior person.

It is yet another objective of the present invention to provide a snowman maker which is inexpensive to manufacture and is attractive in appearance.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1B:
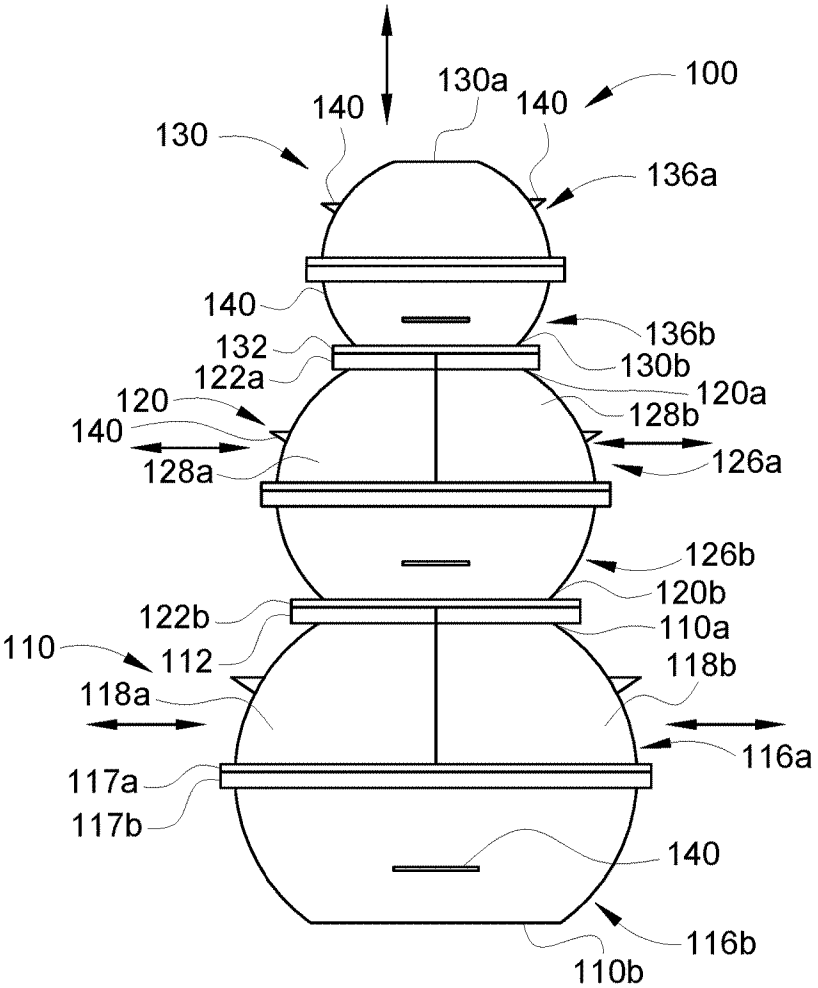
FIG. 1B illustrates a side diagrammatic view of the snowman maker of FIG. 1A, in accordance with one or more embodiments of the present disclosure.
Figure 1A:
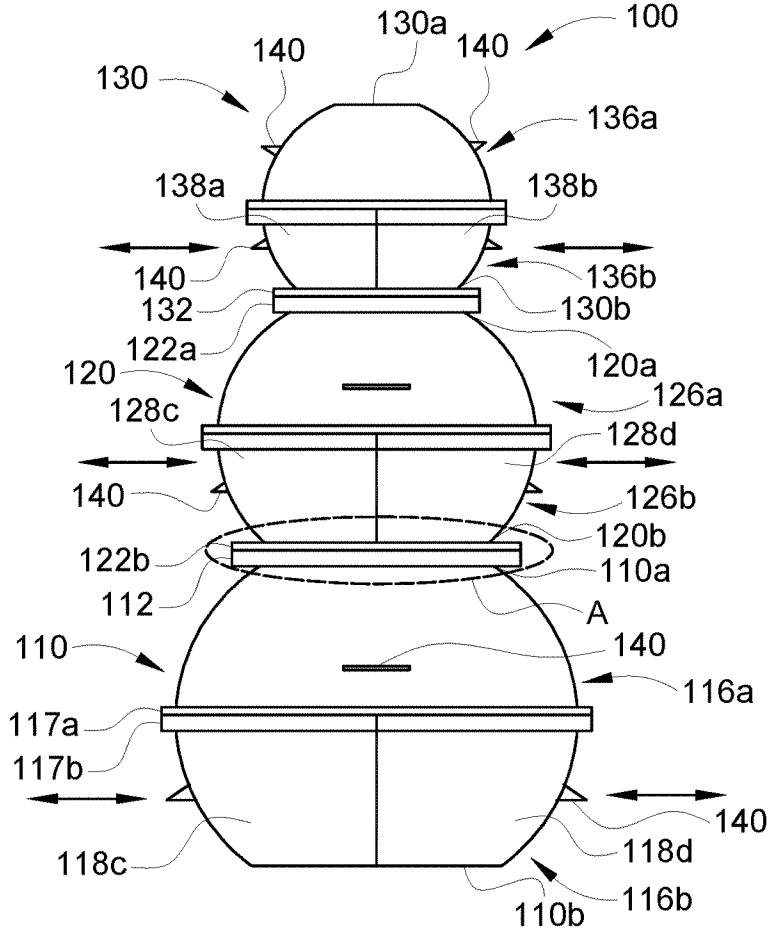
FIG. 1A illustrates a front diagrammatic view of a snowman maker in assembled form, in accordance with one or more embodiments of the present disclosure.

FIGS. 1A and 1B illustrate diagrammatic views of a snowman maker (referred generally by the numeral 100) shown in assembled form, in accordance with one or more embodiments of the present disclosure. As may be known to a person skilled in the art that a typical snowman is formed of three segments, a lower segment which constitutes the hips, legs, feet, etc. of the snowman, a middle segment which constitutes the chest, stomach, etc. of the snowman and an upper segment which constitutes the head of the snowman. When a snowman is made conventionally it usually is composed of three different sized balls of snow vertically stacked upon one another, the bottom ball being of the largest diameter, the top ball being of the smallest diameter and the intermediate ball being of median diameter. Traditionally, each of these segments (or snow balls) are of approximately spherical shape.

Correspondingly, the present snowman maker 100, which can be used for forming a snowman, includes three hollow spherical mold sections, namely a lower mold section 110, a middle mold section 120 and an upper mold section 130. Each of the individual mold sections 110, 120 and 130 of the snowman maker 100 is designed and arranged to mold a different one of three segments of the snowman. That is, the lower mold section 110 is used for forming the said lower segment of the snow man, the middle mold section 120 is used for forming the said middle segment of the snow man and the upper mold section 130 is used for forming the said upper segment of the snow man. It may be contemplated that although the present disclosure has been described in terms of the snowman maker 100 having three mold sections, it may be understood that the present snowman maker 100 may alternatively have more or less number of mold sections for forming other designs and types of snow figures or the like, without any limitations.

As may be seen, the lower mold section 110 is of the largest size of the three mold sections 110, 120 and 130, the middle mold section 120 is smaller than the lower mold section 110, and the upper mold section 130 is of the smallest size. In one example, the snowman maker 100 may have a total height of about 4.5 feet with the lower mold section 110 having a height of about 2 feet, the middle mold section 120 having a height of about 1.5 feet, and the upper mold section 130 having a height of about 1 foot. The mold sections 110, 120 and 130 may have about similar diameters as their corresponding heights. In one or more examples, the mold sections 110, 120 and 130 of the snowman maker 100 are made of light-weight, rigid and thermally-resistant material, such as, but not limited to, plastics; or preferably recycled-plastics. In other examples, the mold sections 110, 120 and 130 may be formed of a light-weight yet rigid metallic material, such as, but not limited to, aluminum. The individual mold sections 110, 120 and 130 are mutually formed such that they can be quickly, easily and readily interlocked with or unlocked from one another, as will be discussed in more detail in the subsequent paragraphs.

In one embodiment, each of the three mold sections 110, 120 and 130 is of a truncated spheroidal shape. That is, each of the three mold sections 110, 120 and 130 is in substantially the shape of a sphere with a portion of its top and a portion of its bottom truncated or cut off by horizontal parallel planes. Due to the upper and lower truncations, each mold section 110, 120 and 130 has an annular top periphery and an annular bottom periphery; namely the lower mold section 110 has a top periphery 110*a* and a bottom periphery 110*b*, the middle mold section 120 has a top periphery 120*a* and a bottom periphery 120*b*, and the upper mold section 130 has a top periphery 130*a* and a bottom periphery 130*b*. At least one of each molds' periphery can include an opening adapted for the entry of snow to fill the molds. In a preferred embodiment, this opening is in the top periphery.

For stacking the three mold sections 110, 120 and 130 on top of each other, it may be contemplated that the horizontal planes about which the three mold sections 110, 120 and 130 are truncated are defined to match the size of the top periphery of one mold section with the size of the bottom periphery of the mold section above thereof. That is, the top periphery 110*a* of the lower mold section 110 is of the same size as the bottom periphery 120*b* of the middle mold section 120, and similarly the top periphery 120*a* of the middle mold section 120 is of the same size as the bottom periphery 130*b* of the upper mold section 130. In one embodiment, upper mold section 130 can be rounded at the top.

Further, as illustrated in FIGS. 1A and 1B, the mold sections 110, 120 and 130 include horizontal flanges provided at mating peripheries thereof that are used to connect and partition each mold by structural tier or level. In particular, the lower mold section 110 includes a flange 112 provided at its top periphery 110*a* thereof, the middle mold section 120 includes two flanges 122*a* and 122*b* provided at the top periphery 120*a* and bottom periphery 120*b* thereof respectively, and the upper mold section 130 includes a flange 132 provided at the bottom periphery 130*b* thereof. In the present examples, flanges 112, 122*a*, 122*b* and 132 are annular (or ring shaped) members extending along the circumference of the corresponding peripheries.

In one example, the flanges 112, 122*a*, 122*b* and 132 may have a width of about 1.5 inches and thickness of about 0.75 inches. It may be appreciated that such dimensions are exemplary only and shall not be construed as limiting to the disclosure. The flanges are removably mounted to each mold. The flanges 112, 122*a*, 122*b* and 132 may be made of same material as the mold sections 110, 120 and 130, i.e. plastic or metallic materials. In other examples, flanges 112, 122*a*, 122*b* and 132 may be made of different material, such as, but not limited to, metals like stainless steel, wood, or the like. Additionally, the top flange may overlap the bottom flange to completely cover the line created at their meeting point.

Figure 2:
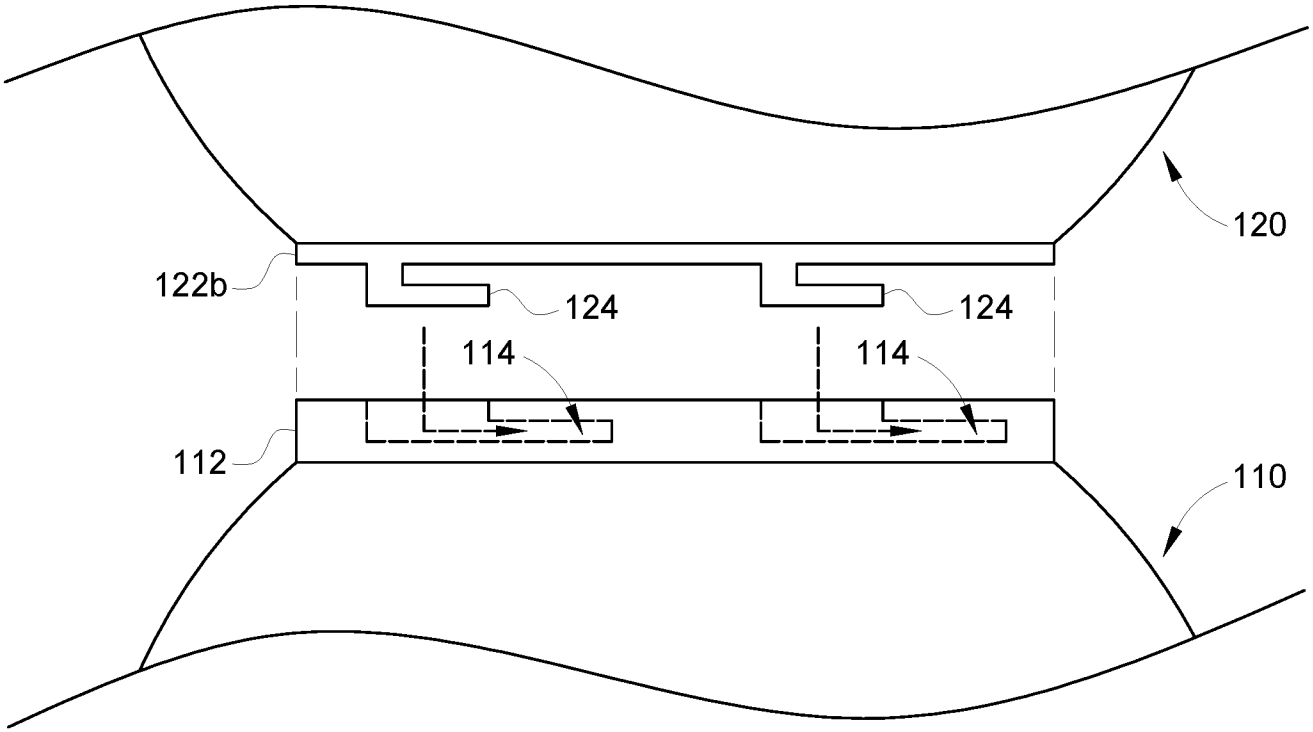
FIG. 2 illustrates an enlarged view of a region A of the snowman maker of FIG. 1A with mold section separated from each other, in accordance with one or more embodiments of the present disclosure.
Figure 3B:
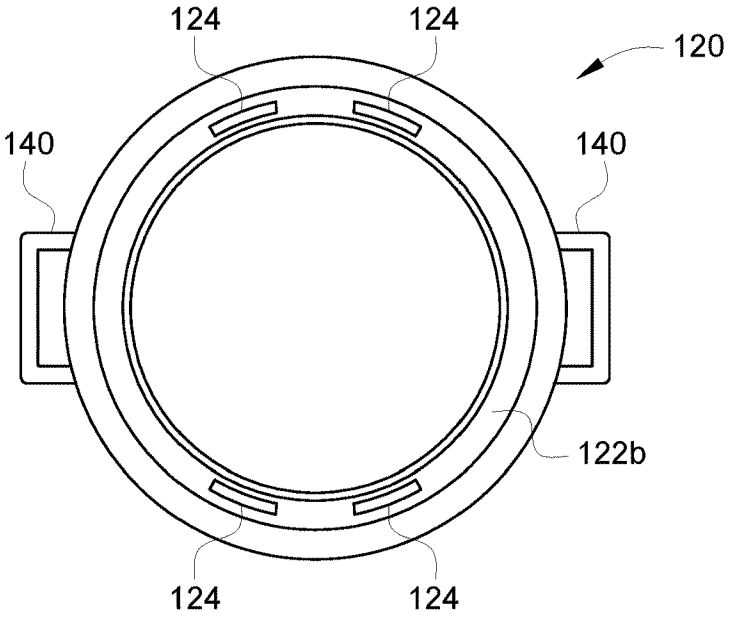
FIG. 3B illustrates a bottom view of a middle mold section of the snowman maker, in accordance with one or more embodiments of the present disclosure.
Figure 3A:
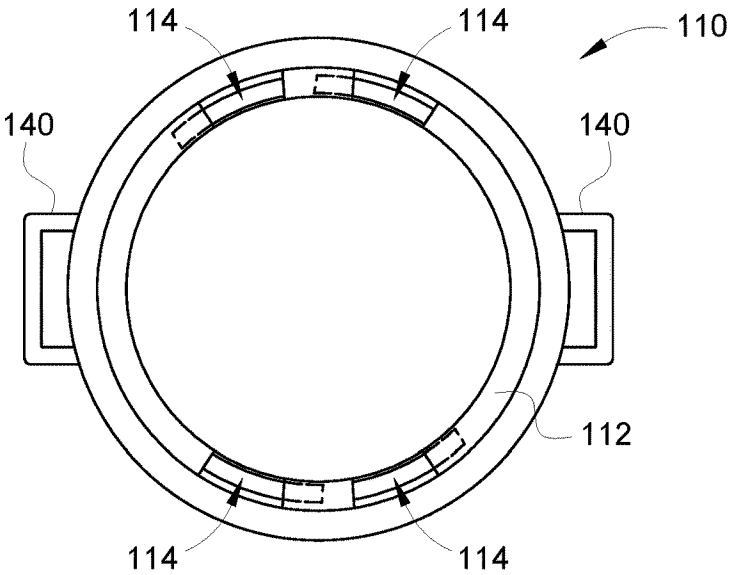
FIG. 3A illustrates a top view of a lower mold section of the snowman maker, in accordance with one or more embodiments of the present disclosure.

FIG. 2 illustrates an enlarged view of a region 'A' of the snowman maker 100 showing portions of the two mold sections, for example, an upper portion of the lower mold section 110 and a bottom portion of the middle mold section 120 separated from each other. Further, FIG. 3A illustrates a top view of the lower mold section 110 and FIG. 3B illustrates a bottom view of the middle mold section 120. As shown in FIG. 2, flange 122*b* of the middle mold section 120 can be partially telescoped into the flange 112 of the lower mold section 110 to create the desired interlocked relationship for assembling the snowman maker 100. In particular, the flange 122*b* may include one or more hooks 124 formed and extending towards the mold under it desired to be connected to. Each of the one or more hooks 124 include a horizontal portion. Further, the flange 112 may have same number of grooves 114 as the hooks 124 in the corresponding flange 122*b*, with each groove 114 having a horizontal part formed therein complementary to the hooks 124. It may be understood that the grooves 114 may have complementary dimensions to the hooks 124 so as to properly receive and securely engage the hooks 124 therein for interlocking purposes. An alternate embodiment to FIG. 2 is for the grooves 114 to have an opening to allow hooks 124 to be released from each flange by a user sliding it laterally, along a Z-axis.

For interlocking the lower mold section 110 with the middle mold section 120, first the flange 122*b* is rested on the flange 112 such that the hooks 124 are aligned with and extend into the grooves 114, and then the entire middle mold section 120 may be rotated or twisted counter-clockwise such that the horizontal parts of the hooks 124 are lodged into the horizontal parts of the grooves 114. In one example, the grooves 114 and the corresponding hooks 124 may be about 2 inches in length along the circular periphery of the corresponding flange. It may be understood that similar arrangement of grooves and corresponding hooks can be used for interlocking the middle mold section 120 with the upper mold section 130 for assembling the snowman maker 100. Such twist-lock mechanism for interlocking two components has been widely employed in the art, and thus has not been described in more detail herein. In alternative embodiments, the snowman maker 100 may utilize other types of known interlocking mechanisms, such as, but not limited to, use of threaded hooks, clips/clamps, latches, rope and strings, magnets, etc. without affecting the scope of the present disclosure. Magnets or hook and loop fasteners can be positioned at the top or bottom periphery of one mold and the corresponding top or bottom periphery of the adjacent mold for mounting purposes.

In an embodiment, as better illustrated in FIGS. 1A and 1B, each of the mold sections 110, 120 and 130 are subdivided into four mating portions or quadrants. In one embodiment, upper mold section 130 can include only three portions. That is, the lower mold section 110 is divided into a top half 116*a* and a bottom half 116*b*, the middle mold section 120 is divided into a top half 126*a* and a bottom half 126*b*, and the upper mold section 130 is divided into a top half 136*a* and a bottom half 136*b*. Each top and bottom half 126*a*, 126*b*, 136*a*, and 136*b* can include a left and right panel further dividing each mold. Each mold can be subdivided into two, three, four or more panels or portions that are removable one from the other and allows for easy storage and more secure assembly. Each left and right panel or portion included in each mold's top and bottom half can be placed in abutting proximity to each other and held in place by the attachment between mold sections. Each left and right panel on each top and bottom half can also be mounted to each other using a tongue and groove extending the width of each mold, magnets, screws, hook and loop fastener, or protrusions with receiving slots. This will be further elaborated below in paragraph 029.

In the present examples, the top halves 116*a*, 126*a* and 136*a* are inter-engageable and inter-lockable with corresponding bottom halves 116*b*, 126*b* and 136*b* respectively, in the mold sections 110, 120 and 130. For such purpose, the mold section halves, i.e. the top halves 116*a*, 126*a* and 136*a* and the bottom halves 116*b*, 126*b* and 136*b* may utilize similar twist-lock interlocking mechanism.

Figure 4:
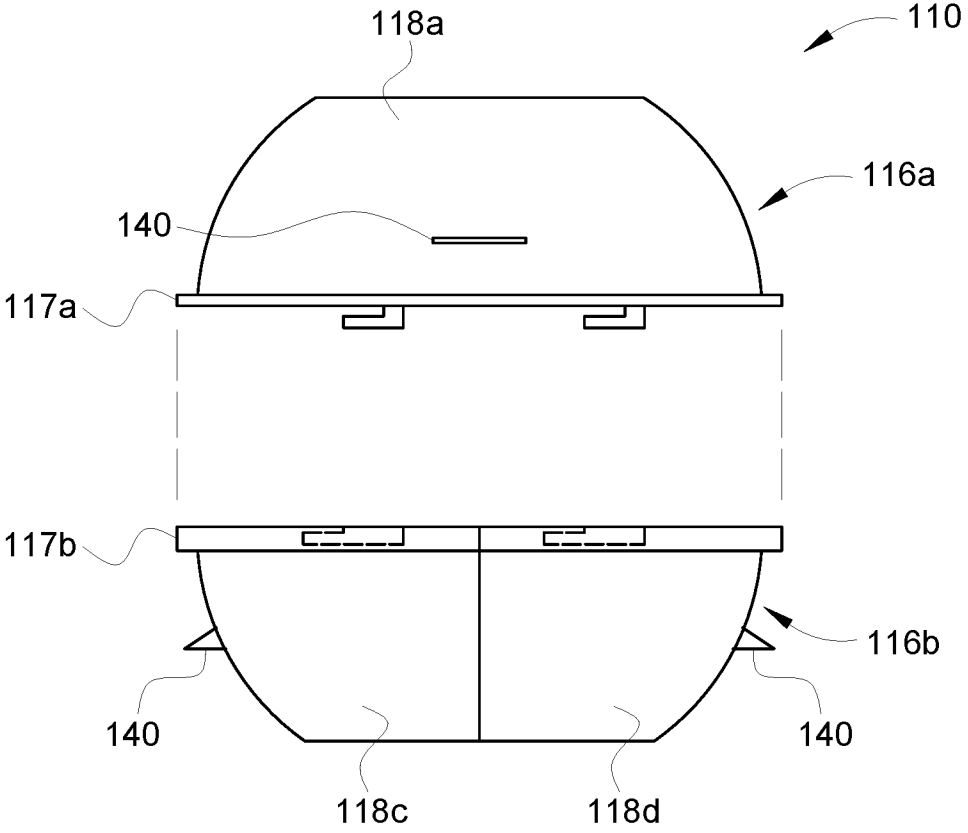
FIG. 4 illustrates a partial exploded view of the lower mold section of the snowman maker, in accordance with one or more embodiments of the present disclosure.

FIG. 4 illustrates a partial exploded view of the lower mold section 110 with the top half 116*a* and the bottom half 116*b* separated from each other. As shown in the illustrated example of FIG. 4, the top half 116*a* have a flange 117*a* and the bottom half 116*b* have a flange 117*b* formed at their circular mating peripheries. It may be seen that the flanges 117*a* and 117*b* are similar to the flanges 122*b* and 112 respectively (as described above). The flanges 117*a* and 117*b* may have similar hooks and corresponding grooves (not labelled), and may be interlocked together in a similar way as discussed for interlocking the mold sections 110, 120 and 130 together, to complete the lower mold section 110. It may be contemplated that similar arrangement may be implemented for assembling and disassembling the mold section halves of the middle mold section 120 and the upper mold section 130, in the snowman maker 100.

Furthermore, in an embodiment, as better illustrated in FIGS. 1A and 1B, each of the mold section halves except for the top half 136 of the upper mold section 130 are further divided into two segments. That is, the top half 116*a* of the lower mold section 110 is divided into a first segment 118*a* and a second segment 118*b*, and the bottom half 116*b* of the lower mold section 110 is divided into a first segment 118*c* and a second segment 118*d*; the top half 126*a* of the middle mold section 120 is divided into a first segment 128*a* and a second segment 128*b*, and the bottom half 126*b* of the middle mold section 120 is divided into a first segment 128*c* and a second segment 128*d*; and only the bottom half 136*b* of the upper mold section 130 is divided into a first segment 138*a* and a second segment 138*b*. In the present examples, the two segments of each mold section halves are slidingly engaged with each other, i.e. the two segments of any mold section half may be brought together by laterally sliding towards each other, and separated by laterally moving away from each other. It may be appreciated that, in alternate embodiments, the mold section halves may be divided into more than two segments, like four segments without any limitations. Top half 136 may be divided to more sections using the aforementioned connection assembly of hooks and grooves, magnets, tongue and groove or protrusion and slot embodiments.

Figure 5:
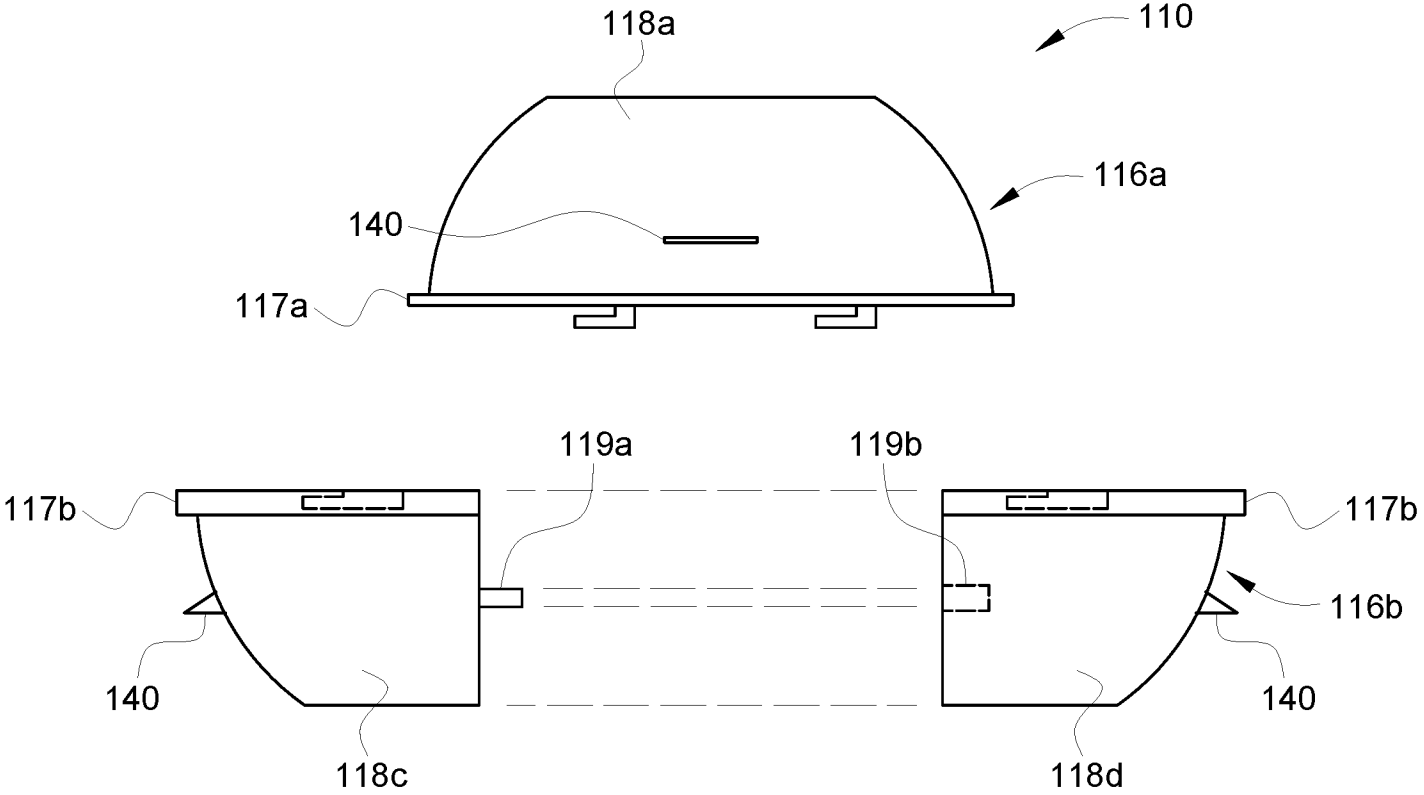
FIG. 5 illustrates an exploded view of the lower mold section of the snowman maker, in accordance with one or more embodiments of the present disclosure.

FIG. 5 illustrates an exploded view of the lower mold section 110 with the top half 116*a* and the bottom half 116*b* separated from each other, and also the first segment 118*a* and the second segment 118*b* (not shown as hidden behind the first segment 118*a*) of the top half 116*a* and the first segment 118*c* and the second segment 118*d* of the bottom half 116*b* separated from each other. As illustrated, the first segment 118*c* may include a protruding member 119*a* and the second segment 118*d* may include a complementary groove 119*b* for receiving the protruding member 119*a* when the first segment 118*c* is laterally forced against the second segment 118*d*, in order to couple the first segment 118*c* and the second segment 118*d* together and thus complete the bottom half 116*b* of the lower mold section 110. The protruding member 119*a* may be designed so it may easily slide out from the groove 119*b* when the first segment 118*c* is laterally pulled out of or moved away from the second segment 118*d*, so as to decouple the first segment 118*c* and the second segment 118*d* when desired. It may be understood that similar arrangement for assembling and disassembling may be implemented for the top half 116*a* of the lower mold section 110, the top half 126*a* and the bottom half 126*b* of the middle mold section 120, and for the bottom half 136*b* of the upper mold section 130, in the snowman maker 100.

In one or more embodiments, handles 140 are provided for each of the mold section halves adjacent to peripheries thereof. The handles 140 may be fixedly attached for conveniently placing and lifting the mold section halves, and/or for conveniently sliding of the segments therein, in order for assembling and disassembling of the snowman maker 100. In alternative examples, the handles 140 may be provided on the flanges in the mold section halves. Although, the handles 140 have been shown to be protruding outwards from the surfaces of the mold section halves; in other examples, the handles 140 may be in the form of cut-outs in the said surfaces without any limitations. In some examples, the first and second segments of each of the mold section halves may be releasably coupled by a pair of latches or clasps or other suitable fasteners, in order to secure the various parts of the snowman maker 100 during assembling thereof. In some examples, the mold section halves may have aligning references, such as raised center lines or the like, for aiding with alignment of the mating mold section halves (specifically alignment of hooks with grooves) with each other, for interlocking thereof. As shown in FIG. 3B, handles 140 can be positioned at the sides of each mold or at the top and bottom of each mold, although not shown in the drawing.

In operation for forming the snowman using the snowman maker 100 of the present disclosure, following steps are carried out in described sequence. Initially, the first segment 118*c* and the second segment 118*d* are brought together by laterally sliding towards each other and inserting the protruding member 119*a* into the groove 119*b* to complete the bottom half 116*b*, and similarly the first segment 118*a* and the second segment 118*b* are brought together by laterally sliding towards each other to complete the top half 116*a*, then the top half 116*a* is aligned and placed on top of the bottom half 116*b*, and finally the top half 116*a* is rotated counter-clockwise to lock itself with the bottom half 116*b* to complete the bottom mold section 110. Afterwards, the hollow interior space of the bottom mold section 110 is filled and packed with snow. Subsequently, the middle mold section 120 is completed by locking its halves and corresponding segments together (similar to the bottom mold section 110). Then, the middle mold section 120 is locked with the bottom mold section 110 (as discussed above). Afterwards, the hollow interior space of the middle mold section 120 is filled and packed with snow. Subsequently, the upper mold section 130 is completed by bringing segments of the bottom half 136*b* together, and then aligning and locking the top half 136*a* therewith. Afterwards, the hollow interior space of the upper mold section 130 is filled and packed with snow.

Now, the mold sections 110, 120 and 130 of the snowman maker 100 needs to be disassembled and removed to reveal the snowman formed inside thereof. In general, the assembly steps (as described in the preceding paragraph) are reversed for this purpose. First, the upper mold section 130 is uncoupled from the middle mold section 120 by rotating it clockwise. Then, the top half 136*a* is lifted, and the segments 138*a* and 138*b* of the bottom half 136*b* are separated. Similarly, the middle mold section 120 is uncoupled from the lower mold section 110, and the segments 128*a* and 128*b* of the top half 126*a* and the segments 128*c* and 128*d* of the bottom half 126*b* are separated by laterally pulling out from each other. And similarly, the lower mold section 110 is uncoupled and its segments separated from each other, thus completely disassembling the snowman maker 100. With all the parts of the snowman maker 100 removed, a near-perfectly formed snowman is revealed.

In the present snowman maker 100, the mold sections 110, 120 and 130 have been designed such that when disassembled they do not disturb the snowman formed inside thereof. In some examples, the design of the mold sections 110, 120 and 130 may allow the segments therein to be laterally separated (during disassembling) at a slight angle or a level plain as to not disturb the snowman formed therein. The lower mold section 110 with a flat bottom base may easily be placed on a ground surface at the desired location for forming the snowman. The mold sections 110, 120 and 130 may have many variations, such as variation in size (smaller or larger), variation in shape (spherical or more cylindrical), variation in size of handles 140 thereof, variation in twist direction (clockwise or counterclockwise for locking), variation in use of hinges, clamps, etc. for locking segments together, and the like.

The snowman maker 100 of the present disclosure provides sectional molds which are inter-lockable in such a fashion that any person can readily assemble and disassemble the same and thereby never has to manipulate more than one comparatively small and lightweight section at a time. The snowman maker 100 with the mold sections 110, 120 and 130 is particularly well-suited for allowing children to safely construct a properly shaped snowman. The present snowman maker 100 of the character described in which the several mold sections are interlocked in an extremely simple manner such that uncoupling of the same is performed automatically, simply by opening individual mold sections and its corresponding segments in a proper order. Thus, the snowman maker 100 of the present disclosure may appeal to a wide range of individuals from children to seniors. The snowman maker 100 provides a fun activity that can be enjoyed outdoors in the winter/snowy months, or whenever the climate permits snow. In some examples, the snowman maker 100 may alternatively be filled with materials other than snow (such as, sand) depending on climate settings in the area. Each of the mold sections may be expanded to the extent of the flange or flanges. It has the same function of the flange, the function is just not visible as the actual mold is expandable and may have hinges that allow it to expand. The thickness of the panel pieces can also have various thickness dimensions to conform with the use of the snowman maker.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A snowman maker, comprising:

three sections being a lower mold section, a middle mold section, and an upper mold section, said three sections being stackable, said upper mold section is smaller than said lower and middle mold sections; said lower mold section, said middle mold section, and said upper mold section each include a top periphery and a bottom periphery, said top periphery or bottom periphery includes an opening adapted to allow a user to at least substantially fill said three sections with snow, said upper mold section includes a laterally extending upper mold bottom flange mounted to said upper mold section's bottom periphery that connects to a laterally extending middle mold top flange mounted to said middle mold section's top periphery, said middle mold section includes a laterally extending middle mold bottom flange mounted to its bottom periphery that engages a laterally extending lower mold top flange mounted to said lower mold section's top periphery, said upper, middle or lower mold section is defined by at least two mating collapsible panels that are completely pulled apart when collapsed.

2. The snowman maker of claim 1 wherein said upper mold section has a top and bottom side, at least one handle located on said top or bottom side.

3. The snowman maker of claim 1 wherein said middle mold section has a top and bottom side, at least one handle located on said top or bottom side.

4. The snowman maker of claim 1 wherein said lower mold section, said middle mold section, and said upper mold section are each substantially spherical.

5. The snowman maker of claim 4 wherein said lower, middle, and upper mold sections are cut off by horizontal parallel planes at its top and bottom side.

6. The snowman maker of claim 1 wherein said flanges extend substantially the length of said three sections bottom or top peripheries.

7. The snowman maker of claim 1 wherein said flanges partially overlap when said three sections are mounted together.

8. The snowman maker of claim 1 wherein said flanges entirely overlap when said three sections are mounted together.

9. The snowman maker of claim 1 wherein said upper mold bottom flange includes an upper hook, said middle mold top flange includes a middle groove that cooperatively receives said upper hook thereby securely engaging said upper mold section to said middle mold section; said middle mold bottom flange includes a middle hook, said lower mold section top flange includes a lower groove that cooperatively receives said middle hook thereby securely engaging said middle mold section to said lower mold section.

10. The snowman maker of claim 1 wherein said middle section top flange includes a side wall having an opening adapted to allow an upper hook to slide out along a Z-axis, said lower section top flange includes a side wall having an opening adapted to allow a middle hook to slide out along said Z-axis.

11. The snowman maker of claim 1 wherein said three sections are engaged and disengaged from each other by rotating each with respect to the adjacent mold section.

12. The snowman maker of claim 1 wherein each of said three sections is sub-divided into said least two mating collapsible panels, thereby making said three sections easy to store.

13. The snowman maker of claim 12 wherein said at least two mating collapsible panels are three panels.

14. The snowman maker of claim 12 wherein said at least two mating collapsible panels are four panels.

15. The snowman maker of claim 12 wherein said upper mold portion is sub-divided into two or three panels, said middle and lower mold sections are each sub-divided into four sections.

16. The snowman maker of claim 12 wherein said at least two mating collapsible panels are mounted to each other using a tongue and groove mechanism.

17. The snowman maker of claim 12 wherein said at least two mating collapsible panels are mounted to each other using magnets.

18. The snowman maker of claim 1 wherein said upper mold section is filled with snow and adapted to make a snowman's face, said middle and lower mold section are filled with snow and adapted to make the torso of a snowman.

19. A snowman maker, comprising:

three sections being a lower mold section, a middle mold section, and an upper mold section, said three sections being stackable, said upper mold section is smaller than said lower and middle mold sections; said lower mold section, said middle mold section, and said upper mold section each include a top periphery and a bottom periphery, said top periphery or bottom periphery includes an opening adapted to allow a user to at least substantially fill said three sections with snow, said upper mold section includes a laterally extending upper mold bottom flange mounted to said upper mold section's bottom periphery that connects to a laterally extending middle mold top flange mounted to said middle mold section's top periphery, said middle mold section includes a laterally extending middle mold bottom flange mounted to its bottom periphery that engages a laterally extending lower mold top flange mounted to said lower mold section's top periphery, said middle mold section and said lower mold section are each defined by at least two mating collapsible panels that are completely pulled apart when collapsed.

* * * * *